US007320273B2

(12) United States Patent
Hayashi et al.

(10) Patent No.: US 7,320,273 B2
(45) Date of Patent: Jan. 22, 2008

(54) COMPRESSOR

(75) Inventors: Sakae Hayashi, Saitama (JP); Hiroshi Kanai, Saitama (JP); Shunichi Furuya, Saitama (JP); Osamu Takazawa, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 372 days.

(21) Appl. No.: 10/540,583

(22) PCT Filed: Nov. 13, 2003

(86) PCT No.: PCT/JP03/14430

§ 371 (c)(1),
(2), (4) Date: Jun. 24, 2005

(87) PCT Pub. No.: WO2004/061307

PCT Pub. Date: Jul. 22, 2004

(65) Prior Publication Data

US 2006/0110264 A1 May 25, 2006

(30) Foreign Application Priority Data

Dec. 26, 2002 (JP) ..... 2002-376859

(51) Int. Cl.
*F01B 3/00* (2006.01)
*F01B 13/04* (2006.01)

(52) U.S. Cl. ..... 92/71; 91/499

(58) Field of Classification Search ..... 92/57, 92/71, 147; 91/499; 417/269
See application file for complete search history.

(56) References Cited

U.S. PATENT DOCUMENTS

| | | | | |
|---|---|---|---|---|
| 3,006,284 | A * | 10/1961 | Pitt et al. | 92/57 |
| 5,626,463 | A | 5/1997 | Kimura et al. | |
| 6,026,731 | A | 2/2000 | Hinrichs | |
| 6,203,290 | B1 | 3/2001 | Tamura et al. | |
| 6,267,561 | B1 * | 7/2001 | Sommars | 417/269 |
| 6,799,953 | B2 * | 10/2004 | Nelson | 417/269 |

FOREIGN PATENT DOCUMENTS

EP 0 979 942 A2 2/2000

(Continued)

OTHER PUBLICATIONS

International Search Report mailed on Mar. 2, 2004.
Supplementary European Search Report (EP 03 77 4015).

*Primary Examiner*—Michael Leslie
(74) *Attorney, Agent, or Firm*—Rader, Fishman & Grauer, PLLC

(57) ABSTRACT

A compressor used in a refrigerating cycle is provided as a miniaturized and lightweight unit at low production cost by selecting an optimal material to constitute components or by forming the housing in a specific shape so as to allow the components to have smaller wall thicknesses while assuring sufficient strength. A tough material achieving a tensile strength greater than 800 N/mm$^2$ is used when forming at least one of the components constituting the housing and the internal mechanisms. In addition, over the area of the housing where the bottom surface and the inner circumferential surface connect with each other, the bottom surface forms an R-shaped portion and the inner circumferential surface forms a sloping portion or an R-shaped portion.

20 Claims, 5 Drawing Sheets

FOREIGN PATENT DOCUMENTS

| | | | |
|---|---|---|---|
| EP | 1 134 413 | A2 | 9/2001 |
| JP | 63-77200 | U | 5/1988 |
| JP | 02-277743 | A | 11/1990 |
| JP | 11-093841 | A | 4/1999 |
| JP | 2000-274369 | A | 10/2000 |
| JP | 2001-020390 | A | 1/2001 |
| JP | 2001-279322 | A | 10/2001 |
| JP | 2002-322547 | A | 11/2002 |
| JP | 2002-364539 | A | 12/2002 |
| JP | 2002-371348 | A | 12/2002 |
| WO | WO-02/10593-AI | | 2/2002 |

* cited by examiner

COMPRESSOR

This application is a U.S. National Phase Application under 35 USC 371 of International Application PCT/JP2003/014430 filed on Nov. 13, 2003.

TECHNICAL FIELD

The present invention relates to a compressor used in a refrigerating cycle.

BACKGROUND ART

A compressor used in a refrigerating cycle in which carbon dioxide is used as a coolant (CO2 cycle) needs to be designed with special care since the pressure and the temperature of the coolant discharged from the compressor in such a refrigerating cycle are bound to be higher than those in a refrigerating cycle in which a coolant such as R134a is used. At present, aluminum materials, which are lightweight and can be cast with ease, are most often used to constitute components (the housing and the internal mechanisms) of the compressor. However, since the tensile strength of aluminum becomes greatly reduced at high temperature, the wall thickness of a component, e.g., the housing, constituted of aluminum needs to be set to a significant value in design in order to assure a sufficient level of strength. For this reason, it is difficult to realize a compressor for a CO2 cycle as a compact unit.

The problem discussed above is addressed in a compressor in the related art used in an automotive air-conditioning system by forming the housing with an extremely sturdy material to enable miniaturization of the compressor (see Japanese Unexamined Patent Publication No. 2000-54958). In this publication of the invention in the related art, it is indicated that the elongation limit of the "sturdy material" should be equal to or higher than 500 N/mm$^2$ and more desirably within a range of 700 to 800 N/mm$^2$ (see Japanese Unexamined Patent Publication No. 2000-54958: paragraph 0012 and claims 7 and 8) and steel, bronze alloys, titanium and fiber-reinforced materials are listed as specific examples (see Japanese Unexamined Patent Publication No. 2000-54958: claims 2 to 6).

Alternatively, a compact compressor may be achieved by modifying the shapes of the components. In an example of this approach in the related art, the piston is formed in a staged shape that includes a large-diameter piston portion and a small-diameter piston portion so as to assume a staged shape and the cylinder bore is formed in the shape conforming to the external contour of the piston so as to reduce the Hertzian stress at the large-diameter piston portion and the large diameter bore portion, thereby achieving miniaturization of the compressor along the axial direction (see Japanese Unexamined Patent Publication No. H11-241677).

However, the "sturdy material" disclosed in Japanese Unexamined Patent Publication No. 2000-54958 described above is less than ideal for the following reasons. First, the materials cited in the publication do not have sufficient elongation limits (yield points) that will allow the compressor to be provided as a miniaturized and lightweight unit at low production costs while assuring the required component strength. In addition, steel, which is among the materials listed in the publication, cannot be cast and thus, the use of steel will lead to an increase in the molding cost. According to JIS H 5114, the minimum value of the tensile strength of a bronze alloy such as an aluminum bronze casting is equal to or smaller than 500 N/mm$^2$, which is short of the required strength in the opinion on the inventor of the present invention et. al. Titanium is an expensive material and the tensile strength of pure titanium is equal to or less than 588 N/mm$^2$ and is, therefore, not sufficient. Examples of fiber-reinforced materials include reinforced plastics. However, the tensile strength of such material is not high enough, e.g., 360 Nmm$^2$ in the case of unsaturated polyester filled with high-strength fiberglass and 250 Nmm$^2$ in the case of special nylon.

In addition, the invention disclosed in Japanese Unexamined Patent Publication No. H11-241677 does not directly relate to a structure for miniaturizing and reducing the weight of the housing which most affects the size and the weight of the entire compressor, and for this reason, it does not significantly contribute to miniaturization, weight reduction and cost reduction with regard to the compressor as a whole.

Accordingly, an object of the present invention is to provide an entire compressor as a miniaturized and lightweight unit at a lowered production cost by selecting an optimal material to constitute a component or by designing the housing in a specific shape so as to allow the component to have a smaller wall thickness while assuring sufficient strength.

DISCLOSURE OF THE INVENTION

In order to achieve the object described above, a compressor according to the present invention used in a refrigerating cycle, which may be provided as a miniaturized and lightweight unit at low production cost by adopting a specific shape in the housing to achieve a reduction in the wall thickness of the component, is characterized in that in an area of the housing where a bottom surface thereof and an inner circumferential surface connect with each other, the bottom surface side of the housing adopts an R-shaped portion whereas the inner circumferential surface side of the housing forms a sloped portion or an R-shaped portion.

By adopting the R shape and the sloping shape at the connecting area, the pressure that would otherwise concentrate in the connecting area can be dispersed and, as a result, the pressure-withstanding performance of the housing is improved, which allows the housing to have a wall thickness smaller than that in the related art.

In addition, in consideration of maximizing the pressure dispersing effect and also the requirements related to the compressor design (factors such as the range over which the piston is allowed to move), it is desirable that the R-shaped portion on the bottom surface side measure in a range of 2 to 10 mm, that the largest diameter in the R-shaped portion on the bottom surface side be equal to or greater than the internal diameter of the housing and the sloped portion on the inner circumferential surface side be achieved in the form of a circular cone connecting the largest diameter portion of the R-shaped portion on the bottom surface side with the inner circumferential surface side.

Alternatively, a compressor used in a refrigerating cycle according to the present invention, which allows components thereof to have smaller wall thicknesses by selecting optimal material to constitute the components, is characterized in that a tough material achieving a tensile strength greater than 800 N/mm$^2$ at normal temperature is used to form at least one component among the components constituting the housing and the internal mechanisms.

The results of the investigation and the research conducted by the inventor of the present invention et. al indicate that a compressor can be provided as a miniaturized and lightweight unit at low production cost by forming components of the compressor with a tough material such as iron instead of the materials in the related art such as aluminum, as long as the tensile strength of the tough material at the compressor operating temperature (approximately 150° C.) is equal to or greater than three times the tensile strength of the materials in the related art, since this level of tensile strength allows the components such as the housing to have smaller wall thicknesses while assuring a sufficient level of strength. FIG. 2 presents a graph indicating the relationship between the temperature and the tensile strength δβ, with a line A representing the tensile strength of iron and a line B representing the tensile strength of an aluminum alloy. The graph indicates that the tensile strength of the aluminum alloy decreases at a greater rate than the tensile strength of iron as the temperature rises, and that this tendency becomes more pronounced when the temperature exceeds 150° C. The tendency in the tensile strength δβ of the aluminum alloy is of great concern since the maximum operating temperature of the compressor reaches approximately 180° C. in the refrigerating cycle. As a point C indicates, the tensile strength of the aluminum alloy normally used to constitute the housing and the like of the compressor today is 250 N/mm$^2$ at approximately 150° C. A point D on the line A indicates that a tensile strength δβ, which, at 750 N/mm$^2$, is three times the tensile strength at the point C, is achieved at 150° C. and a point E on the line A indicates that the tensile strength δβ of 800 N/mm$^2$ is achieved at normal temperature Tr (15 to 20° C.). These findings suggest that in order to assure the tensile strength of iron (a tough material) which is at least three times that of the aluminum alloy (the material in the related art) during compressor operation (at approximately 150° C.), the tensile strength δβ of the tough material must be equal to or greater than 800 N/mm$^2$ at normal temperature Tr.

FIG. 3 presents a graph of the weight ratios of iron materials with varying tensile strengths relative to the weight of an aluminum alloy with a tensile strength δβ of 250 N/mm$^2$ indicated with a bar L. A bar M indicates that the weight ratio of an iron material A with a tensile strength δβ of 620 N/mm$^2$ (2.5 times the tensile strength of the aluminum alloy, i.e., 250) is 0.98, whereas a bar N indicates that the weight ratio of an iron material B with a tensile strength δβ of 750 N/mm$^2$ (three times the tensile strength of the aluminum alloy, i.e., 250) is 0.78. The graph indicates that by using the iron material B with the tensile strength (750 N/mm$^2$), three times the tensile strength (250 N/mm$^2$) of the aluminum alloy commonly used at present to constitute a component such as the housing, the component is allowed to have a smaller wall thickness while assuring a sufficient level of strength, as can be predicted based upon the weight ratio (0.78) of the iron material B. By using such a material, the compressor can be provided as a miniaturized and lightweight unit at lower production cost.

According to the present invention, it is desirable that the tensile strength of the tough material at the maximum operating temperature be equal to or greater than 80% of the tensile strength at normal temperature. By using a material that manifests only a small change in the tensile strength between the operating state and the nonoperating state, the reliability and the like of the product can be improved.

The tough material may be cast iron and the cast iron should be austempered so as to achieve a bainitic structure.

Cast iron (an iron alloy with a carbon content of 1.7% or more) is an ideal choice since it is inexpensive and can be machined with ease. In addition, the toughness level of cast iron can be improved through austempering.

Alternatively, the tough material may be a titanium alloy, preferably having undergone a solution heat treatment and an aging treatment. While a titanium alloy is usually a tough material to begin with, the toughness of a titanium alloy having undergone the solution heat treatment and aging treatment is further improved.

Ideally, the tough material should be manufactured through casting or through a powder metallurgical method.

As described above, the use of the tough material allows a member such as the housing to have a smaller wall thickness and thus, the compressor can be provided as a miniaturized and lightweight unit at low production cost while assuring the required level of strength.

In consideration of the fact that it has been so far difficult to achieve miniaturization of the compressor constituting part of a refrigerating cycle using carbon dioxide as a coolant, which must operate in a high temperature, high-pressure environment, the compressor according to the present invention is ideal in an application in a CO2 refrigeration cycle.

BEST MODE FOR CARRYING OUT THE INVENTION

Figure 1:
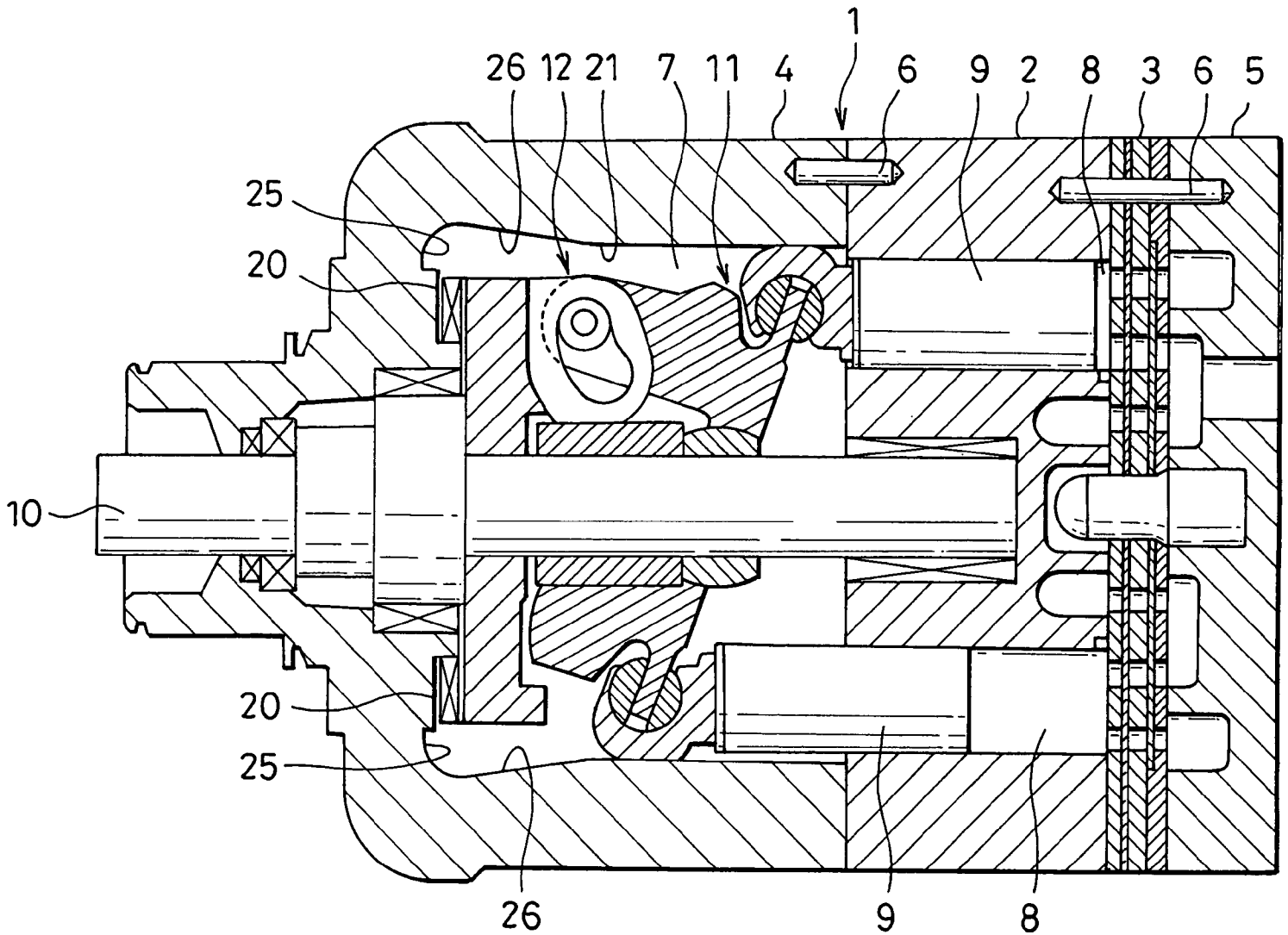
FIG. 1 is a sectional view of the structure adopted in the compressor according to the present invention.

The following is an explanation of embodiments of the present invention, given in reference to the attached drawings. A compressor 1 in FIG. 1 is utilized in a supercritical vapor compression refrigerating cycle in which carbon dioxide is used as a coolant (a CO2 cycle). The housing of the compressor 1 is constituted by fastening together a cylinder block 2, a valve plate 3 and a front head 4 and a rear head 5 with bolts 6 along the axial direction.

In a crank case 7 defined by the front head 4 and the cylinder block 2, internal mechanisms such as pistons 9 that move reciprocally inside compression spaces 8 formed within the cylinder block 2, a drive shaft 10, a swash plate mechanism 11 that rotates in synchronization with the drive shaft 10 to cause the reciprocal movement of the pistons 9, a rotating support member (not shown) that tiltably links the drive shaft 10 to the swash plate mechanism 11 and the like are disposed.

Figure 2:
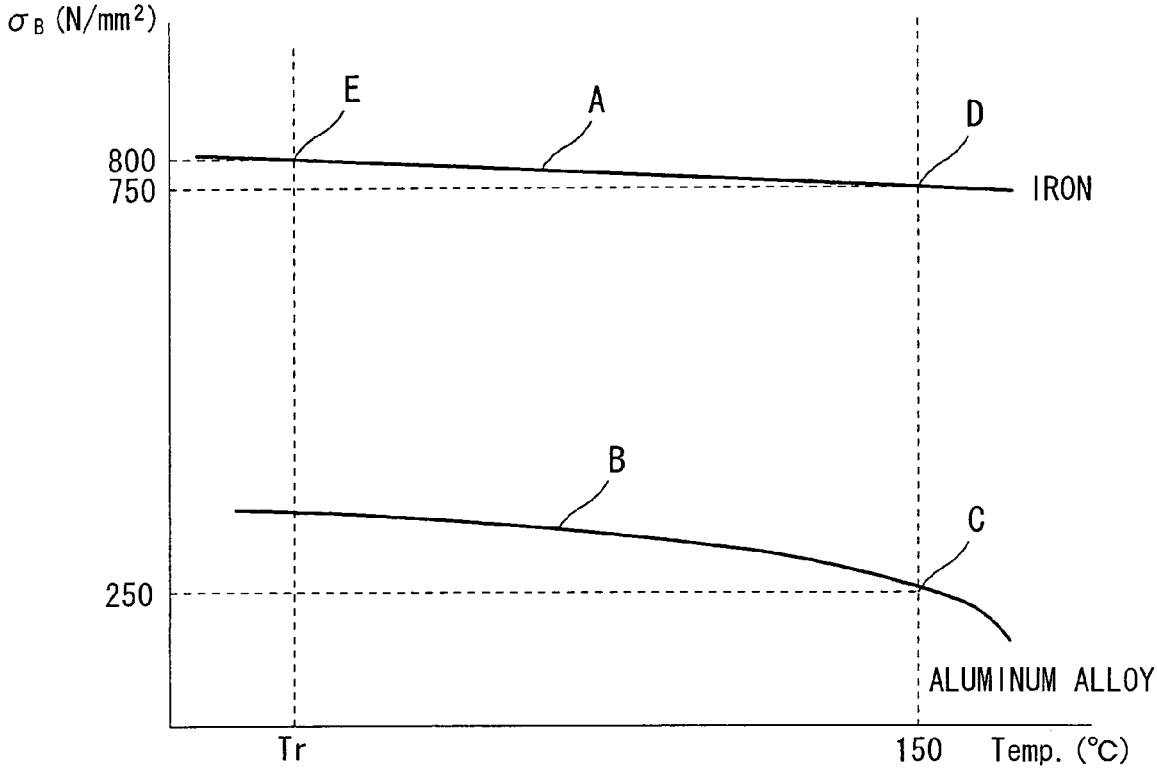
FIG. 2 is a graph showing the relationships between the temperature and the tensile strengths of iron and an aluminum alloy.

In the compressor 1 structured as described above, the members (2, 3, 4 and 5) constituting the housing, at least, are formed by using a tough material with a tensile strength δβ greater than 800 N/mm$^2$ at normal temperature Tr (15 to 20° C.). The requirement for the tough material, i.e., δβ>800 N/mm$^2$ at normal temperature, has been determined by taking into consideration that the tensile strength δβ (750 N/mm$^2$) of the tough material (iron) at the operating temperature for the compressor 1, i.e., approximately 150° C., at the point D in FIG. 2 should be three times the tensile strength δβ (250 N/mm$^2$) of the aluminum alloy commonly used to constitute the compressor housing in the related art at the point C and that the tensile strength δβ of the tough material should not become lower as a high rate as the temperature rises.

Figure 3:
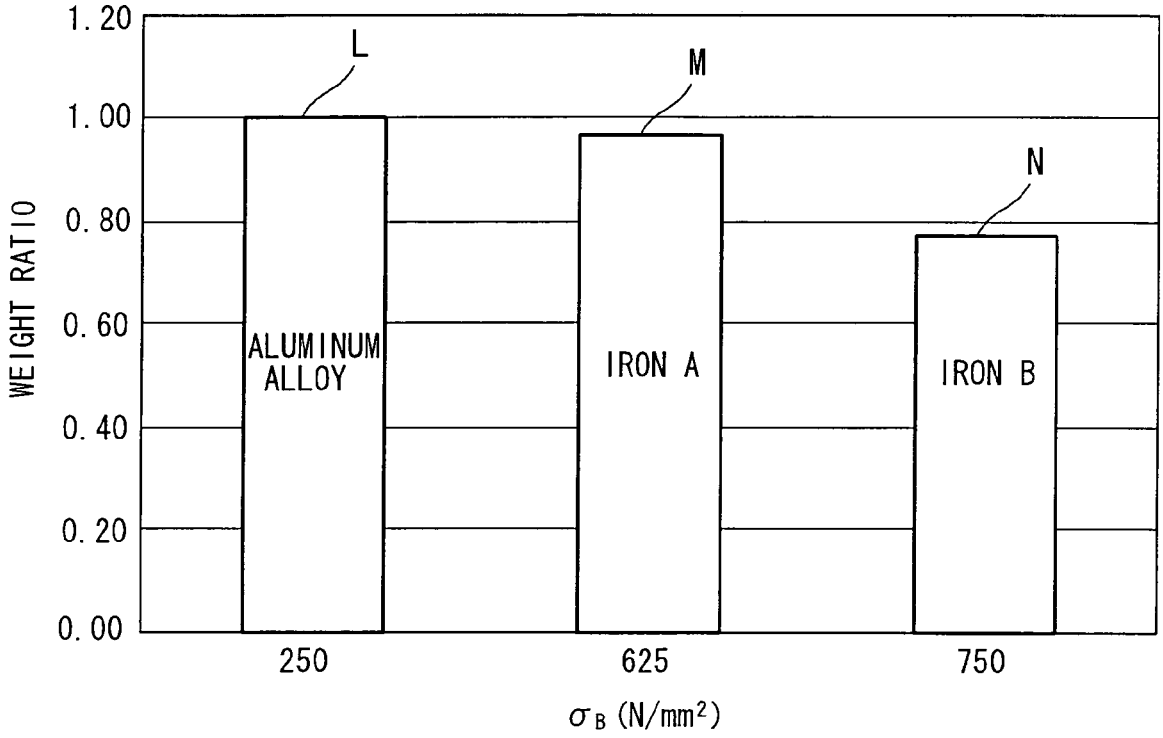
FIG. 3 is a graph of the weight ratios of iron materials with varying tensile strengths relative to the weight of an aluminum alloy with a tensile strength δβ of 250 N/mm$^2$.
Figure 4:
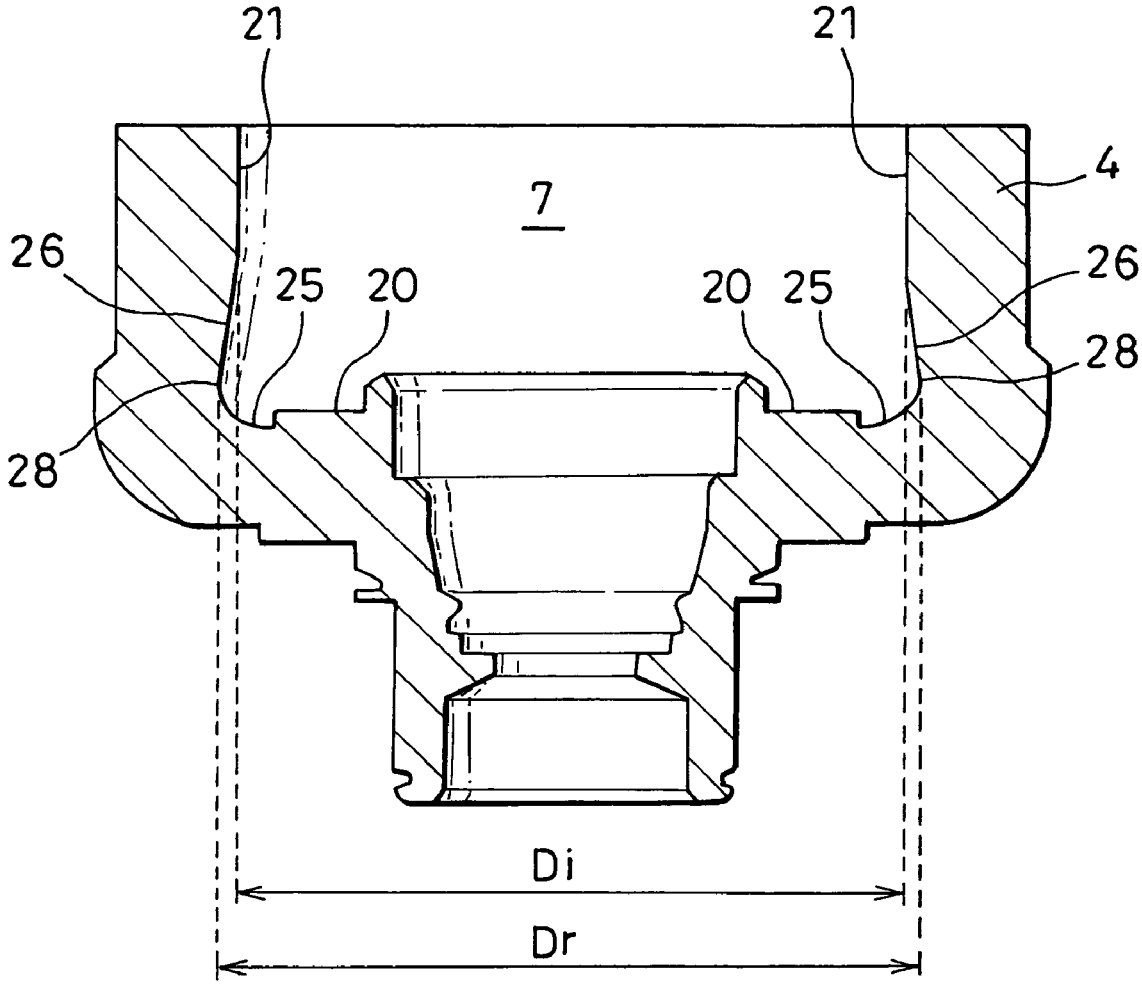
FIG. 4 is an enlarged sectional view showing part of the internal contour of the housing (front head) adopted in an embodiment of the present invention.

As FIG. 3 shows, the weight ratio of the iron material B (the bar N) having a tensile strength (750 N/mm$^2$) three times the tensile strength of the aluminum alloy, i.e., 250 N/mm$^2$ is 0.78 relative to the weight of the aluminum alloy. Accordingly, by using the iron material B to constitute the compressor housing and other components of the compressor, the wall thicknesses of the components can be set to smaller values while assuring sufficient strength, and thus it becomes possible to provide the compressor as a miniaturized and lightweight unit at low production cost.

It is also desirable to use a tough material with a tensile strength at the maximum operating temperature (e.g., 180° C.) for the compressor 1, which is equal to or greater than 80% of the tensile strength at normal temperature. The use of such a tough material further improves the reliability of the product.

A tough material may be cast iron. Cast iron is an iron alloy with a carbon content of 1.7% or more. The iron alloy will normally contain silicon, manganese, phosphorus and the like as well as carbon, can be cast with ease and assures superior wear resistance and machinability. In addition, it is desirable to austemper such cast iron to achieve a bainitic structure in the iron. In the austempering treatment, the material having been heated to a desired temperature to achieve a stable austenitic structure is rapidly cooled in a cooling agent, the temperature of which is kept within a correct temperature range equal to or lower than the ferrite and pearlite formation temperature and equal to or higher than the martensite formation temperature while inhibiting modification, the material having been cooled in the temperature range is then caused to become modified so as to have a bainitic structure and finally, the material is cooled down to room temperature. Through this treatment, the material becomes proof against distortion and quenching and it also becomes tougher.

As an alternative, a titanium alloy may be used as the tough material. A titanium alloy includes titanium and another transition metal as its main constituents and is normally a tough material. In addition, it is desirable to use a titanium alloy having undergone a solution heat treatment and an aging treatment. In the solution heat treatment, the alloy is heated to a temperature in the higher solid solution range, and is held at the temperature for a specific length of time until it achieves a solid solution state. The aging treatment, through which the alloy having been rapidly cooled and cold worked is then left to manifest a change in the material characteristics (hardness) over time, is implemented in this instance for purposes of hardening the alloy through aging.

It is desirable to manufacture the tough material through casting or through a powder metallurgical method to assure a high level of mass productivity and low production cost.

By using the tough material described above, it becomes possible to design a component such as the housing with a small wall thickness while assuring a sufficient level of strength and, as a result, the entire compressor 1 can be provided as a miniaturized and lightweight unit at low production cost. It is to be noted that while the tough material is used to constitute the housing in the embodiment explained above, the present invention is not limited to this example and it may be adopted in a structure that includes an internal mechanism constituted with the tough material.

The following is an explanation of a structure having a housing formed in a specific shape which allows the housing to have a small wall thickness. As shown in FIG. 1, the bottom surface 20 and an inner circumferential surface 21 are present inside the front head 4. The bottom surface 20 is a substantially circular surface facing opposite the cylinder block 2 and having a hole through which the drive shaft 10 passes, whereas the inner circumferential surface 21 is a substantially cylindrical surface connecting the edge of the bottom surface 20 with the cylinder block 2.

The compressor 1 adopting this particular structure is characterized in that the bottom surface 20 forms an R-shaped portion 25 and the inner circumferential surface 21 assumes a sloping portion 26 over an area where the bottom surface 20 and the inner circumferential surface 21 become connected with each other. Since the shapes of the bottom surface and the inner circumferential surface make it possible to disperse the pressure which would otherwise concentrate over the connecting area, the pressure withstanding performance of the front head 4 improves, which, in turn, allows the wall thickness of the front head 4 to be reduced in design compared to that in the related art.

In addition, in order to maximize the pressure dispersing effect and also to satisfy the requirements related to the compressor design (factors such as the range over which the piston 9 is allowed to move), it is desirable that the R-shaped portion on the bottom surface side measure in a range of 2 to 10 mm, that the largest diameter in the R-shaped portion 25 on the bottom surface side be equal to or greater than the internal diameter Di of the inner circumferential surface 21 of the housing (front head 4) and that the sloping portion 26 on the inner circumferential surface side be achieved in the form of a circular cone connecting the largest diameter portion 28 of the R-shaped portion 25 on the bottom surface side with the inner circumferential surface side.

Figure 5:
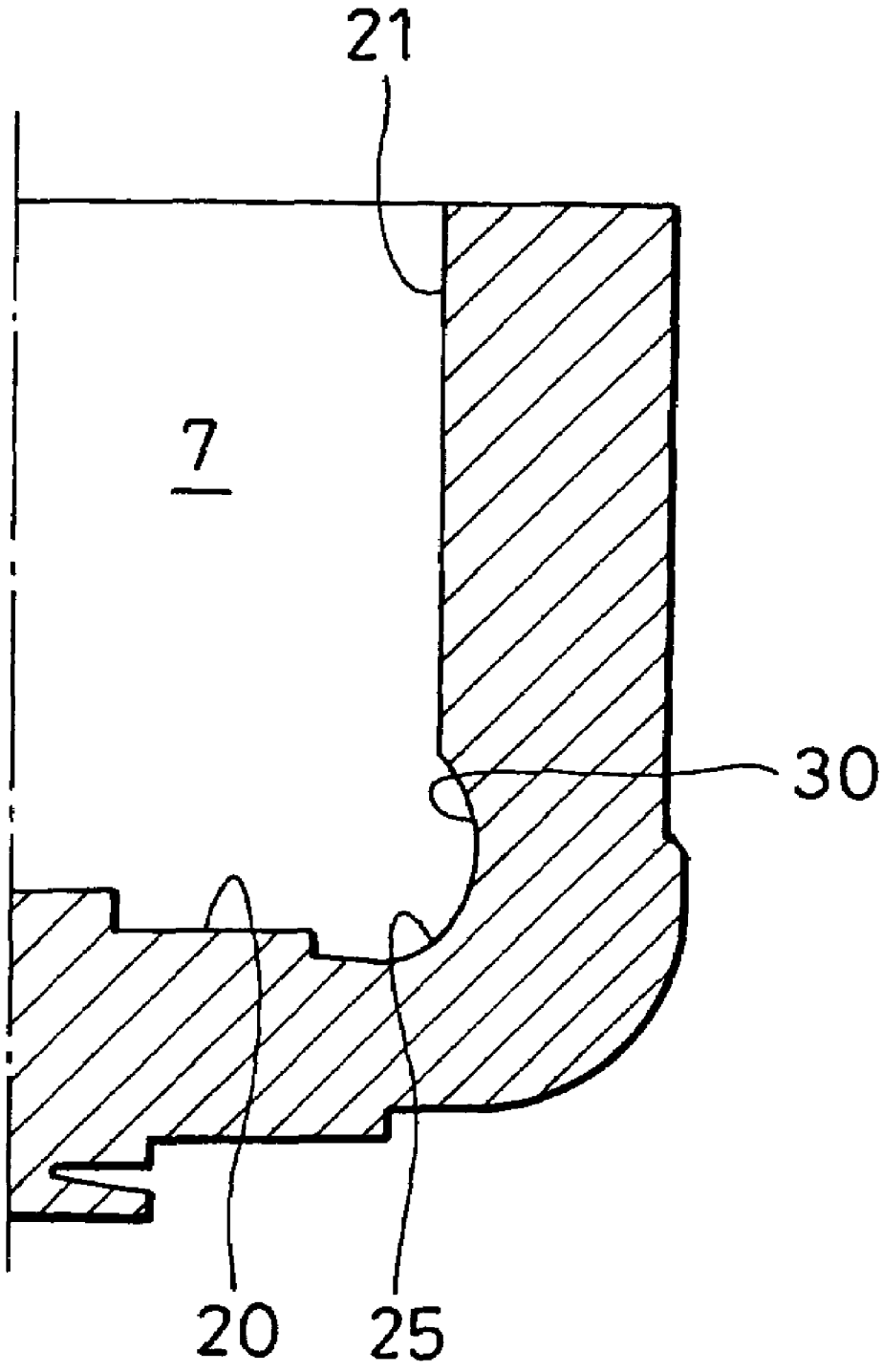
FIG. 5 is an enlarged sectional view showing part of the internal contour of the housing (front head) adopted in another embodiment of the present invention.

FIG. 5 shows the contour of the area where the bottom surface 20 and the inner circumferential surface 21 connect with each other, which may be adopted in another embodiment of the present invention. In this embodiment, the inner circumferential surface 21, too, forms an R-shaped portion 30 similar to the R-shaped portion 25 formed at the bottom surface 20. This structure, too, improves the pressure withstanding performance of the front head 4 to allow the front head 4 to have a smaller wall thickness compared to the related art, as does the structure achieved in the preceding embodiment.

INDUSTRIAL APPLICABILITY

As described above, by using the tough material to constitute a component such as the housing, it becomes possible to set the wall thickness of the component to a smaller value while assuring a sufficient level of strength, and as a result, the compressor can be provided as a miniaturized and lightweight unit at low production cost. Alternatively, the housing may be formed in a specific shape as described above so as to improve the pressure withstanding performance of the housing. This allows the wall thickness of the housing to be set smaller compared to the related art.

The invention claimed is:

1. A compressor used in a refrigerating cycle wherein:

in an area where a bottom surface and an inner circumferential surface of a housing connect with each other, said bottom surface forms an R-shaped portion and said inner circumferential surface forms a sloping portion or an R-shaped portion with said sloping portion of said inner circumferential surface achieving a substantially circular conic contour connecting the largest diameter portion of said R-shaped portion at said bottom surface and said inner circumferential surface.

2. A compressor according to claim 1, wherein:

at least one of components constituting said housing and internal mechanisms is formed by using a tough material achieving a tensile strength greater than 800 $N/mm^2$ at normal temperature.

3. A compressor according to claim 2, wherein:

said tough material is cast iron.

4. A compressor according to claim 3, wherein:

said cast iron has undergone an austempering treatment and has a bainitic structure.

5. A compressor according to claim 2, wherein:

said tough material is a titanium alloy.

6. A compressor according to claim 5, wherein:

said titanium alloy has undergone a solution heat treatment and an aging treatment.

7. A compressor according to claim 2, wherein:

said tough material is manufactured through casting.

8. A compressor according to claim 2, wherein:

said tough material is manufactured through a powder metallurgical method.

9. A compressor used in a refrigerating cycle, wherein:

in an area where a bottom surface and an inner circumferential surface of a housing connect with each other, said bottom surface forms an R-shaped portion and said inner circumferential surface forms a sloping portion or an R-shaped portion with the largest diameter of said R-shaped portion at said bottom surface equal to or larger than the internal diameter of said inner circumferential surface of said housing;

wherein said R-shaped portion at said bottom surface measures in a 2 to 10 mm range.

10. A compressor according to claim 9, wherein:

at least one of components constituting said housing and internal mechanisms is formed by using a tough material achieving a tensile strength greater than 800 N/mm at normal temperature.

11. A compressor according to claim 10, wherein:

said tough material is cast iron.

12. A compressor according to claim 11, wherein:

said cast iron has undergone an austempering treatment and has a bainitic structure.

13. A compressor according to claim 10, wherein:

said tough material is a titanium alloy.

14. A compressor according to claim 13, wherein:

said titanium alloy has undergone a solution heat treatment and an aging treatment.

15. A compressor used in a refrigerating cycle, wherein:

in an area where a bottom surface and an inner circumferential surface of a housing connect with each other, said bottom surface forms an R-shaped portion and said inner circumferential surface forms a sloping portion or an R-shaped portion with the largest diameter of said R-shaped portion at said bottom surface equal to or larger than the internal diameter of said inner circumferential surface of said housing;

wherein the tensile strength of said tough material at maximum operating temperature is equal to or greater than 80% of the tensile strength at normal temperature.

16. A compressor according to claim 15, wherein:

said tough material is cast iron.

17. A compressor according to claim 16, wherein:

said cast iron has undergone an austempering treatment and has a bainitic structure.

18. A compressor according to claim 15, wherein:

said tough material is a titanium alloy.

19. A compressor according to claim 18, wherein:

said titanium alloy has undergone a solution heat treatment and an aging treatment.

20. A compressor used in a refrigerating cycle, wherein:

in an area where a bottom surface and an inner circumferential surface of a housing connect with each other, said bottom surface forms an R-shaped portion and said inner circumferential surface forms a sloping portion or an R-shaped portion with the largest diameter of said R-shaped portion at said bottom surface equal to or larger than the internal diameter of said inner circumferential surface of said housing;

wherein carbon dioxide is used as a coolant.

* * * * *